United States Patent [19]

Hagan et al.

[11] Patent Number: 4,773,571

[45] Date of Patent: Sep. 27, 1988

[54] SELTZER PACKAGE, VALVE, POPPET AND SPRING

[75] Inventors: Richard J. Hagan, San Carlos; John J. McIntyre, Foster City, both of Calif.

[73] Assignee: McKesson Corporation, San Francisco, Calif.

[21] Appl. No.: 8,628

[22] Filed: Jan. 29, 1987

Related U.S. Application Data

[63] Continuation-in-part of Ser. No. 844,619, Mar. 27, 1986, abandoned.

[51] Int. Cl.[4] ..... B65D 83/00

[52] U.S. Cl. ..... 222/394; 222/402.13; 222/402.15; 222/402.25; 222/505; 222/494; 222/542; 222/545; 267/148; 267/158; 267/47; 137/903; 137/852; 251/321; 251/244

[58] Field of Search ..... 222/394, 518, 402.13, 222/402.15, 402.25, 464, 505, 494, 542, 545; 215/315; 267/148, 149, 158, 163, 42, 44, 47; 251/321, 244; 137/903, 852

[56] References Cited

U.S. PATENT DOCUMENTS

| | | | |
|---|---|---|---|
| 676,009 | 6/1901 | Ripper | 222/394 X |
| 2,088,248 | 7/1937 | Perry | 137/903 X |
| 2,372,392 | 3/1945 | Pletman | 222/402.25 X |
| 2,830,745 | 4/1958 | Aicart | 222/402.13 X |
| 3,153,498 | 10/1964 | Bakker | 222/542 X |
| 3,682,466 | 8/1972 | Huchette et al. | 267/149 X |
| 4,126,558 | 11/1978 | Luceyk | 137/903 X |
| 4,597,511 | 7/1986 | Licari | 137/903 X |
| 4,694,975 | 9/1987 | Hagan | 222/545 X |

FOREIGN PATENT DOCUMENTS 766618 7/1949 Fed. Rep. of Germany ..... 267/163

*Primary Examiner*—Joseph J. Rolla
*Assistant Examiner*—Gregory L. Huson
*Attorney, Agent, or Firm*—Flehr, Hohbach, Test, Albritton & Herbert

[57] ABSTRACT

A package (10) for dispensing a fluid (26) in the package under gas pressure has a biaxially oriented polyethelene terepthalate bottle (12) with a neck (14). A dispensing head (22) is attached to the neck (14). A normally closed valve (16) is mounted in the neck and has a housing (50) sealed to the inside surface of the neck (14). The housing (50) has a syphon flange (54). An integral structure (56) having a spring (58) at one end and a poppet (60) at a second end rests on the syphon flange (54). The housing has an opening (48) above the syphon flange 54). The integral structure (56) extends between the syphon flange (54) and the opening (48). The integral structure (56) is dimensioned so that the spring (58) is compressed to bias the poppet end of the integral structure (56) into sealing engagment around the opening (48). The dispensing head (22) has an integral diaphragm (42) and rods (52) and (46) extending above and below the diaphragm (42). Lever (24) applies downward force on the rods (52) and (46) to move the poppet end of the integral structure (56) out of sealing engagement around opening (48) to create a flow path (92) for the fluid (26) in the package (10) through the valve housing (50), the opening (48) and spout (28) of the head (22). A resilient grommet (148) forms a second seal around the opening between the housing and the poppet end of the integral structure.

24 Claims, 6 Drawing Sheets

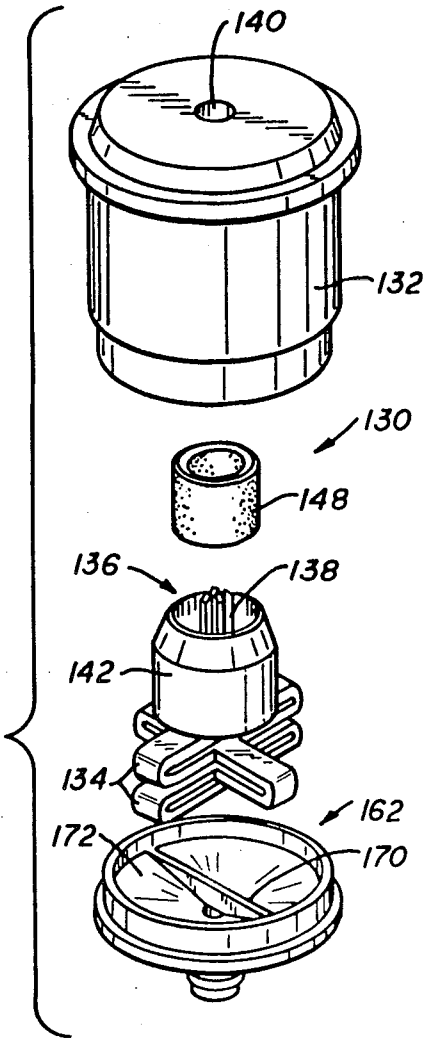
FIG._12.
FIG._11.
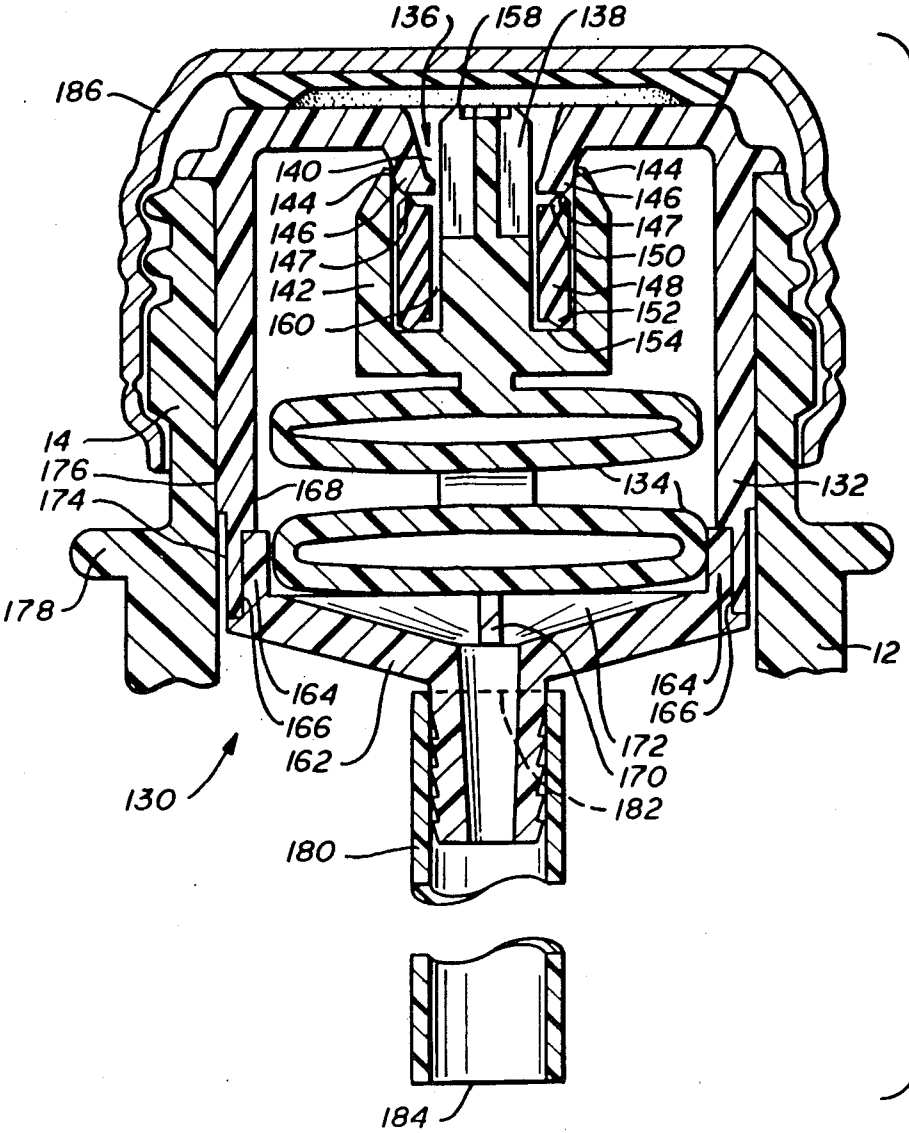

SELTZER PACKAGE, VALVE, POPPET AND SPRING

CROSS REFERENCE TO RELATED APPLICATIONS

This application is a continuation-in-part of our earlier application Ser. No. 06/844,619, filed Mar. 27, 1986, now abandoned.

This application and the following copending applications by Richard J. Hagan are directed to related inventions: Ser. No. 06/685,912, filed Dec. 27, 1984 and entitled "Method and Apparatus for Storing and Dispensing Fluids Containered Under Gas Pressure" abandoned in favor of Ser. No. 06/924,186, filed Oct. 24, 1986, now U.S. Pat. No. 4,694,975; Ser. No. 06/635,450, filed July 31, 1984 and entitled "Syphon Assembly and Package Incorporating the Assembly";, now U.S. Pat. No. 4,671,436 Ser. No. 06/687,296, filed Dec. 28, 1984 and entitled "Integral Syphon Package Head";, now U.S. Pat. No. 4,660,748 Ser. No. 06/893,041, filed Aug. 1, 1986 and entitled, "Ultrasonically Welded Container and Process"; and Richard J. Hagan and Dennis A. Lempert, Ser. No. 06/704,763, filed Feb. 20, 1985 and entitled, "Seltzer Filling Apparatus and Process", now U.S. Pat. No. 4,617,973.

BACKGROUND OF THE INVENTION

1. Field of the Invention

This invention relates to an improved package for holding and dispensing liquids under pressure. More particularly, it relates to such a package incorporating a novel poppet valve, to the poppet valve, to a novel integral poppet and biasing spring, and to a novel spring used to bias the poppet valve to a normally closed position. Most especially, it relates to such a spring, poppet and spring combination and valve especially adapted for use in a syphon package for holding and dispensing the liquids under pressure.

2. Description of the Prior Art

The extensive prior art pertaining to syphon seltzer water packages has been set forth in the first related application listed above. Briefly, until the inventions of the first three related applications, seltzer water was conventionally packaged in thick glass bottles with permanently attached heads. The bottles were filled through the heads, shipped to the consumer, used by the consumer and returned to the bottler for cleaning and refilling, all without removing the head from the bottle. In order to dispense the seltzer water through a syphon, pressures of about 90 pounds per square inch are required, substantially higher than for conventional carbonated beverages. Glass containers filled to such pressures are dangerous. This fact and the economics of the distribution process resulted in a decline in the syphon seltzer water business to the point that syphon seltzer water is available in only a few areas of the United States at the present time.

The inventions of the above related applications have, for the first time, made it practical to package syphon seltzer water in plastic bottles with the dispensing head separated from the bottles. The packages disclosed in the first three related applications include a normally closed valve in the neck of the containers. The bottles may be shipped in conventional distribution channels with twist-off caps, which the consumer removes and replaces with a reusable dispensing head which is used to open the valve in order to dispense the seltzer water from the package. Unlike conventional carbonated beverage containers, these packages and the higher pressures employed allow the seltzer water to remain pressurized until the container is emptied, so that the product does not go flat when the container is partly empty.

Such packages impose stringent requirements on the valves used in them. The valves must provide a hermetic seal, be extremely reliable in operation and very low in cost. In order to be suitable for their intended use, the valves must be capable of forming a reliable, hermetic seal at pressures of 100 pounds per square inch (p.s.i.) or more and at lower pressures, between about 40 p.s.i. and atmospheric pressure. This is because the pressure in such seltzer syphon packages must be at least 90 p.s.i. when the container is filled, so that sufficient pressure will remain in the container when it is almost empty to force the remaining liquid from the package. When the package is almost empty, a seal that is effective at the higher pressures may not be maintained at the lower pressures then present in the package. The development of the inventions in the related applications have resulted in further improvements in such packages and their valves.

SUMMARY OF THE INVENTION

Accordingly, it is an object of this invention to provide a package for storing and shipping a fluid under pressure and subsequently dispensing fluid from the package utilizing the pressure incorporating an improved, low cost valve.

It is another object of the invention to provide such a package in which the container and the valve may be fabricated from the same plastic material.

It is a further object of the invention to provide an improved, low cost valve that is suitable for use in such packages.

It is still another object of the invention to provide a novel spring and poppet structure for use in such a valve.

It is yet another object of the invention to provide a novel plastic spring suitable for use in such a spring and poppet structure and such a valve.

It is another object of the invention to provide such a package and valve incorporating a first hermetic seal that is effective at high pressures and a second hermetic seal that is effective at lower pressures.

It is a further object of the invention to provide such a package and valve incorporating two hermetic seals that maintains consistent dimensional relationship with a part of the package which actuates the valve.

The attainment of these and related objects may be achieved through use of the novel package, valve, spring and poppet structure and spring herein disclosed. A package for dispensing a fluid in the package under pressure in accordance with this invention includes a container having a necked opening with an inside surface, a dispensing head attached to the necked opening, and a normally closed valve mounted in the necked opening of the container. The normally closed valve has a housing fixedly attached to the inside surface of the necked opening of the container. The housing has a supporting surface below the necked opening. An integral structure has a spring at a first end and a poppet at a second end. The spring end of the integral structure rests on the supporting surface. The housing has an orifice defining a valve seat at the necked opening of the container. The valve seat orifice is spaced from the supporting surface, with the integral structure extending between the supporting surface and the valve seat orifice. The integral structure is dimensioned so that the spring is sufficiently compressed to bias the poppet end of the integral structure into sealing engagement with the valve seat orifice. A means on the dispensing head applies force in opposition to the biasing force from the spring to move the poppet end of the integral structure out of sealing engagement with the valve seat orifice. This creates a flow path for the fluid in the package through the valve housing, the valve seat orifice and the necked opening of the container. In a preferred form of the package and valve, the poppet and housing form a first hermetic seal at high pressures, such as above about 40 p.s.i. At lower pressures, between about 40 p.s.i. and atmospheric pressure, a resilient member between the poppet and the housing provides a second hermetic seal with the housing. For storing and shipping the fluid under pressure, the dispensing head need not be attached to the necked opening of the bottle, and a conventional closure is preferably provided over the valve, both for sanitary and safety reasons.

An integral structure in accordance with this invention has a spring at a first end and a poppet at a second end. The spring end of the integral structure includes a first elongated loop, transversely extending from the integral structure. At least a second elongated loop extends transversely from the integral structure and is oriented at an angle relative to the first elongated loop.

A plastic spring in accordance with this invention includes a first elongated loop. At least a second elogated loop is oriented at an angle relative to the first elongated loop. The first and second loops are attached at a midsection of each loop in a stacked relationship.

In a preferred form of the invention, the spring, integral spring and poppet structure, valve and container are formed from the same plastic material, desirably polyethylene terephthalate (PET). The poppet and valve housing form the first hermetic seal capable of withstanding the higher pressures as a PET to PET seal. The resilient member creating the second hermetic seal effective at the lower pressures, at which the PET to PET seal is sometimes not effective, is desirably formed from an elastomeric material. The spring and integral spring and poppet structure give a valve that is capable of meeting the requirements for a plastic syphon seltzer package which allows syphon seltzer water to be stored and shipped with a screw off cap, which the consumer replaces with a dispensing head at the time of beginning to dispense the syphon seltzer water.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 11 is a cross section view of a portion of still another syphon seltzer package in accordance with the invention.

FIG. 12 is an exploded perspective view of part of the seltzer syphon package portion shown in FIG. 11.

DETAILED DESCRIPTION OF THE INVENTION

Figure 2:
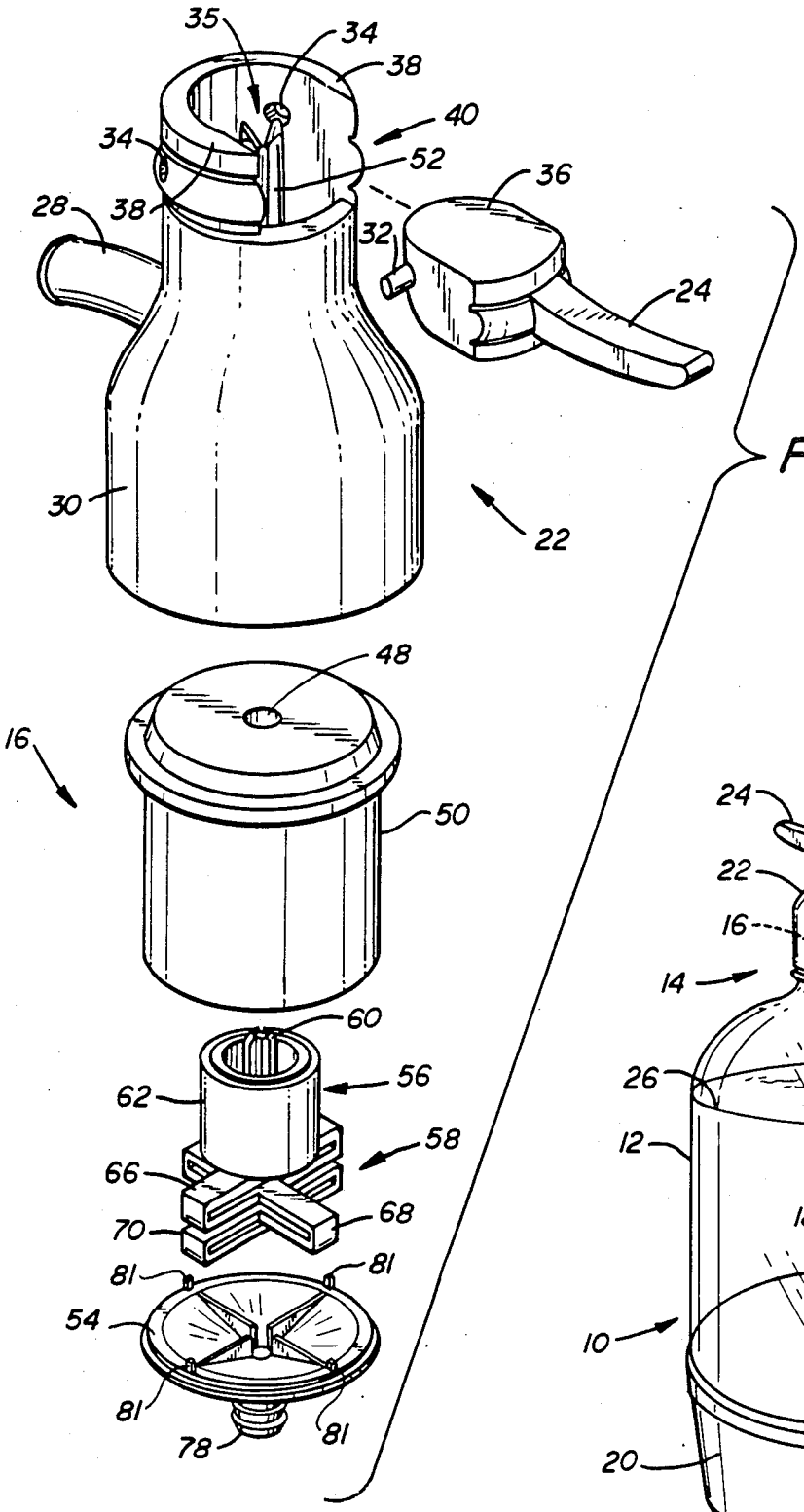
FIG. 2 is an exploded perspective view of a portion of the syphon seltzer package shown in FIG. 1.
Figure 1:
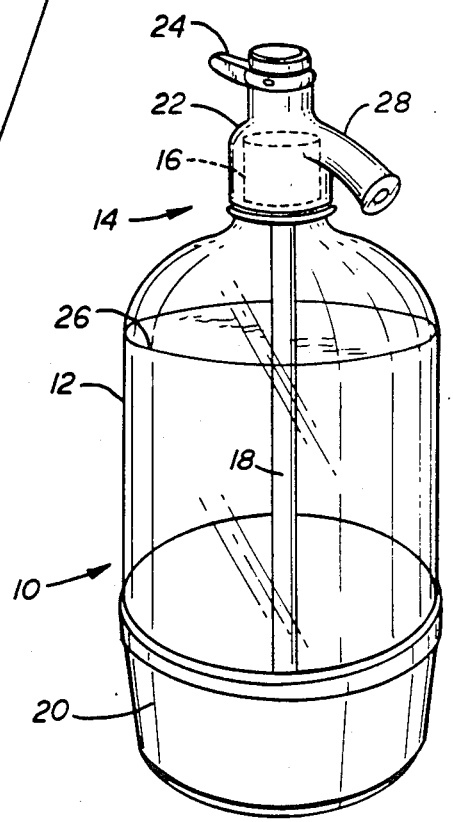
FIG. 1 is a perspective view of a syphon seltzer package in accordance with the invention.
Figure 4:
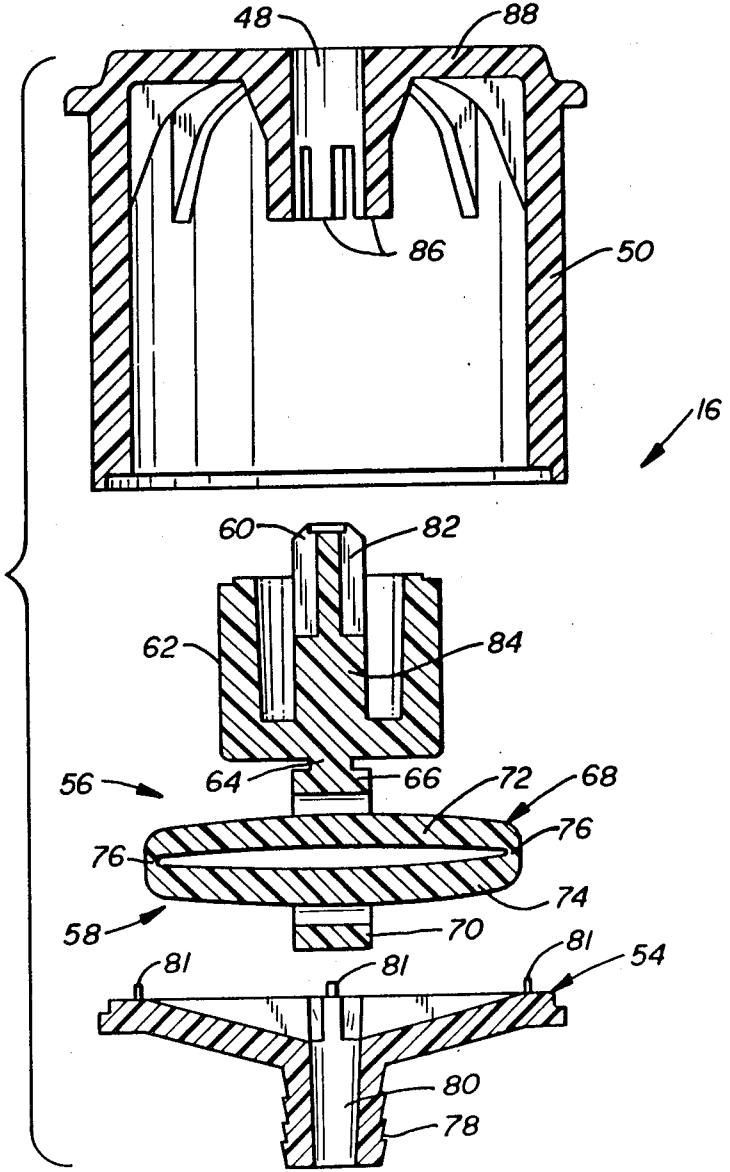
FIG. 4 is an exploded side cross section view of another part of the syphon seltzer package portion shown in FIG. 2.
Figure 3:
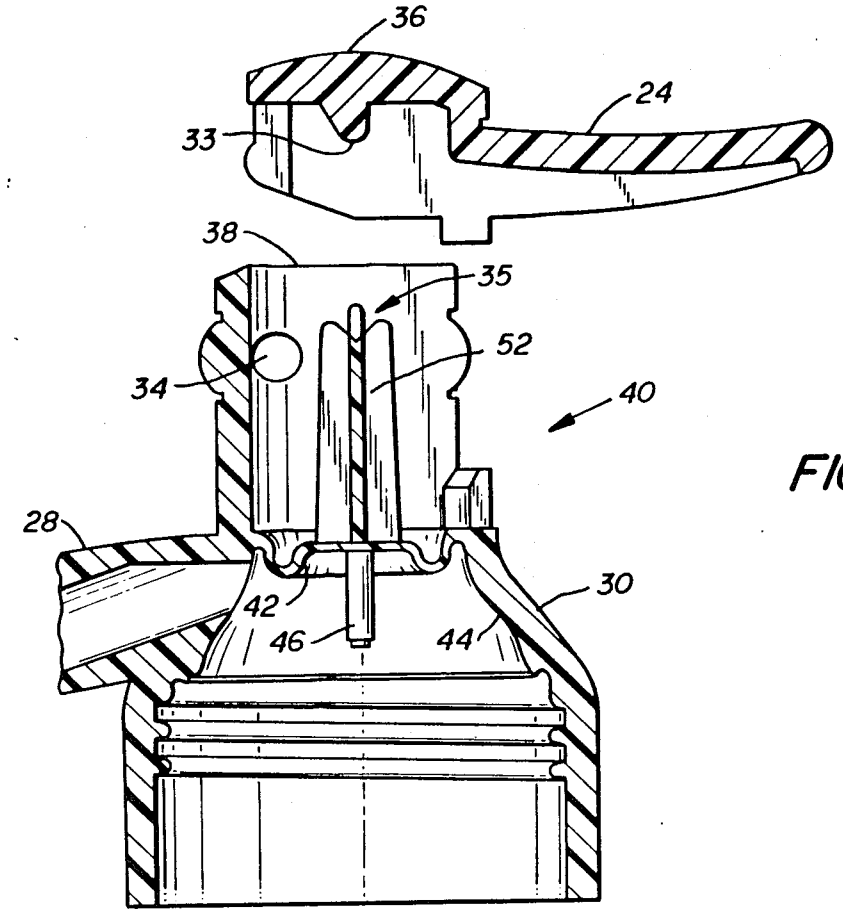
FIG. 3 is an exploded side cross section view of part of the syphon seltzer package portion shown in FIG. 2.

Turning now to the drawings, more particularly to FIG. 1, there is shown a syphon seltzer package 10 in accordance with the invention. The package 10 has a biaxially oriented PET bottle 12 having a neck 14 with a normally closed valve 16 in the neck 14. A syphon tube 18 extends downward from the valve 16 to the bottom of the bottle 12. A base cup 20 is mounted to the bottom of the bottle 12. A head 22 is threadably attached by mating threads on the neck 14 of the bottle. Depressing lever 24 opens the normally closed valve 16 to allow seltzer water 26 in the bottle 12 to be dispensed from spout 28.

Further details of the head 22 and the valve 16 are respectively shown in FIGS. 2, 3 and 8 and FIGS. 2, 4 and 7. The head 22 has a body 30, and the lever 24 is pivotally mounted at the top of the body 30 by means of projections 32, which engage mating slots 34 in the body 30 (see FIG. 8). Top 36 of the lever 24 is curved to form a substantial part of the top of the body 30 when the lever 24 is in place. The remainder of the top is formed by portions 38 of the body 30 on either side of the lever 24. Slot 40 extends down the side of the body 30 to provide clearance for the lever 24 as the lever 24 pivots downward to open the valve 16. The body 30 of the head 22 has an integrally formed diaphragm 42 extending across inside surface 44 of the body 30 above the spout 28. Rod 46 extends downward from and is integrally formed with the diaphragm 42 to engage the valve 16 through opening 48 in valve housing 50. Rod 52 has a cruciform cross section, extends upward from and is integrally formed with the diaphragm 42 to engage the lever 24 by means of projection 33 on the underside of top 36 of the lever 24. The projection fits into recess 35 at the upper end of the rod 52. Threads 53 on the inside of the head body 30 engage mating threads 90 (FIGS. 5 and 6) on the neck 14 of the bottle 12 to fasten the head 22 over the valve 16.

Valve 16 has a syphon flange 54 which forms the bottom of the valve housing 50. An integral structure 56 inside the valve housing 50 has a spring end 58 and a poppet end 60. A cup 62 surrounds the poppet 60. The poppet 60 and cup 62 are joined to the spring 58 by pedestal 64. The spring 58 is formed from loops 66, 68 and 70, which intersect one another at right angles (see FIG. 7). Each of the loops 66, 68 and 70 has an arcuate top 72 and bottom 74 joined by ends 76 of reduced thickness. The integral structure 56 is supported within the housing 50 on the syphon flange 54. With the syphon flange in place on the housing 50, the spring 58 is compressed to preload the valve 16 into a normally closed position. In practice, the integral structure is dimensioned with respect to the housing 50 so that the spring 58 gives a preload of about 3 pounds in the assembled valve. After a shelf life of about 16 weeks for the package 10, a preload of about 1.5 pounds remains in the valve. The syphon tube 18 is attached to the syphon flange 54 by means of fitting 78, which has a central bore 80 communicating through the syphon flange 54 with the interior of the valve housing 50. The syphon flange 54 has four registration pins 81, located at 90 degree angles around the circumference of the flange 54, which help in registration of the syphon flange 84 with the valve housing during assembly.

The poppet 60 of the integral structure 56 has a cruciform cross section portion 82 and a cylindrical cross section portion 84 beneath the portion 82. When the valve is assembled, the portion 82 extends into the opening 48 in the housing 50. The opening 48 has a castellated bottom 86 which engages the cylindrical portion 84 to center the integral poppet and spring structure 56 in the housing 50. The cup 60 engages top 88 of the housing 50 to seal the valve 16 in its normally closed position when poppet 60 is in place in opening 48 and the preloaded spring 58 urges the cup 62 against the top 88.

Figure 5:
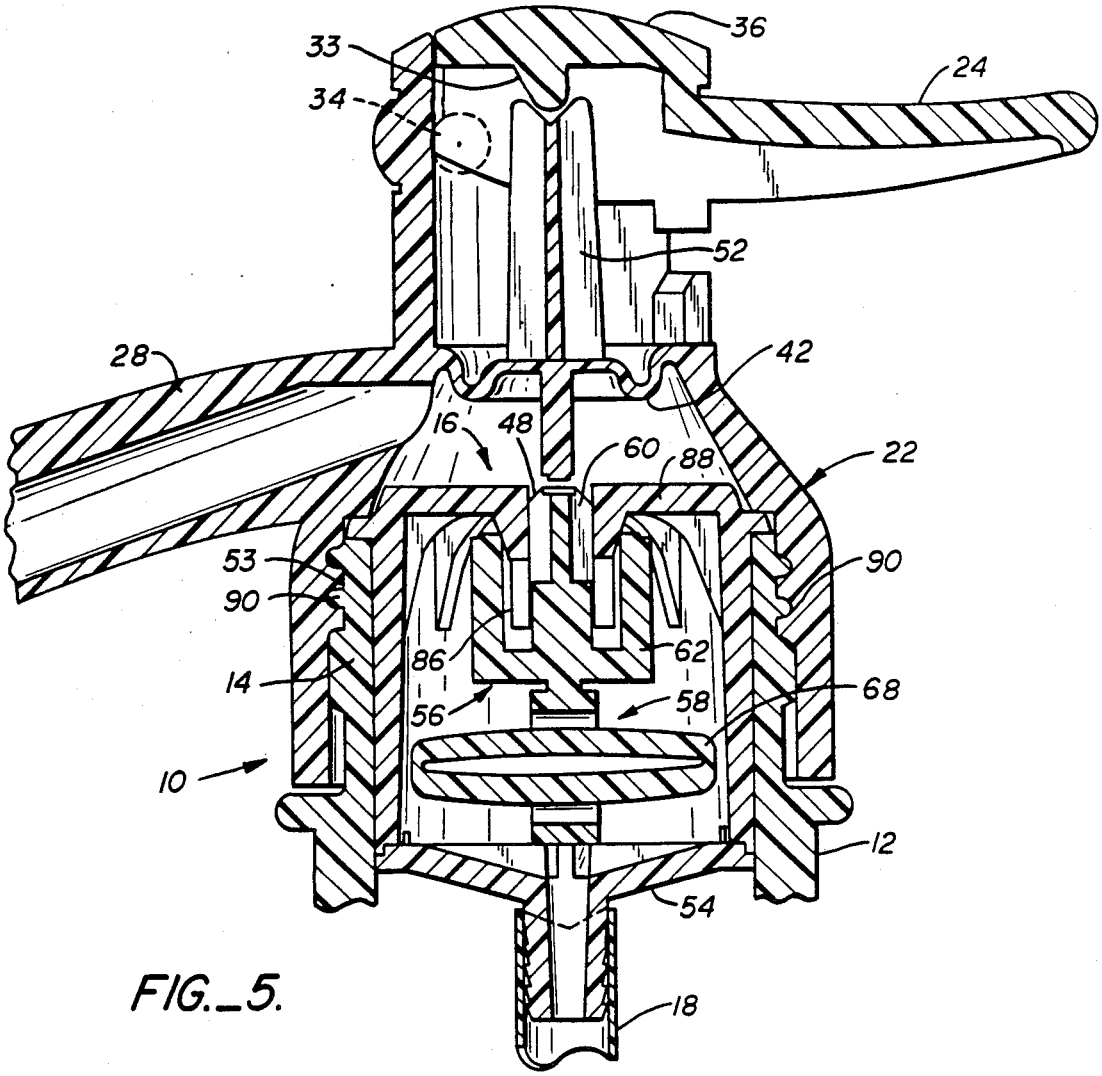
FIGS. 5 and 5*a* are a side schematic section views of the syphon seltzer package shown in FIG. 1.
Figure 6:
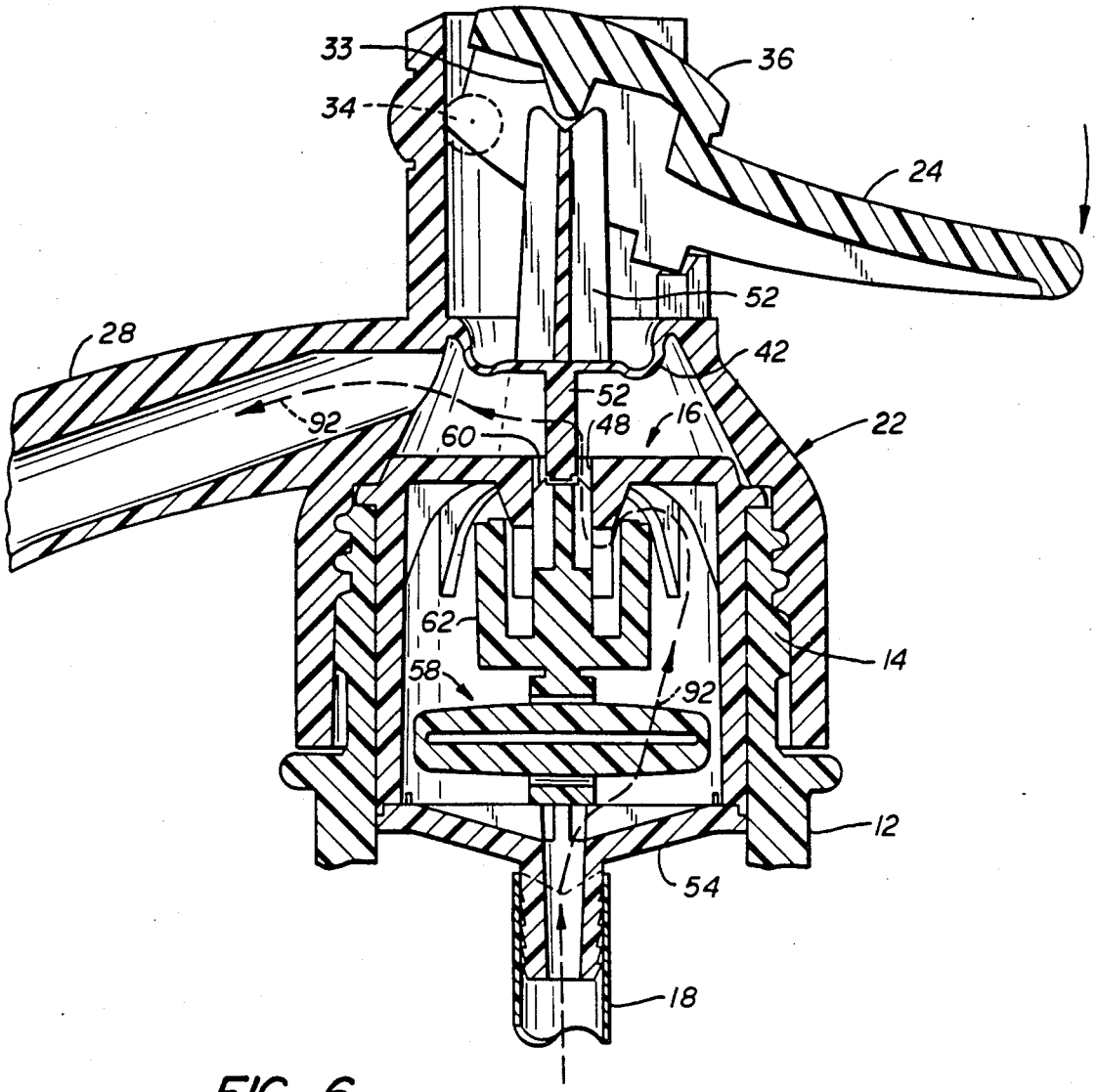
FIG. 6 is another side schematic section view of part of the syphon seltzer package shown in FIGS. 1, 5 and 5*a*, but in another operating position.

FIG. 5 shows the package 10 with the valve 16 in its normally closed position. As shown, the integral structure 56 is biased upward by the compressed spring 58, so that cup 62 pushes against the top 88 of the valve housing 50 in sealing engagement and poppet 60 extends fully into the opening 48. A fluid and gas tight seal between the cup 62 and the top 88 is created by the preload on the spring 58. Pressure exerted by the seltzer water 26 in the package 10 against the integral structure 56 further helps to maintain the fluid tight seal.

For storage and shipment of the package 10, the head is usually not in place on the neck 14. A conventional aluminum twist off cap is provided over the closed valve 16 and engaging threads 90. The cap provides a safety feature in the unlikely event of failure of the valve 16, but is not exposed to the pressure of the seltzer water 26 with the valve 16 closed.

At the time of first dispensing from the package 10, the consumer removes the twist off cap and replaces it with the head 22, to give the package assembly as shown in FIG. 5. To open the valve 16, the user depresses the lever 24 to the position shown in FIG. 6. As the lever 24 moves downward, it pushes down on the rod 52 to flex the diaphragm 42 downward, moving the rod 46 against the poppet 60 to move cup 62 out of sealing engagement with the top 88 of the valve housing 50. A flow path 92 for the seltzer water 26 through the flange 54, around the spring 58, over the cup 62, past the poppet 60, through the opening 48 and out the spout 28 is therefore created. To turn off the dispensing of the seltzer water, the user releases the lever 24, and the lever 24 and valve 16 return to the position shown in FIG. 5, with the valve 16 in its normally closed state. The diaphragm 42 exerts an upward biasing force on the rod 52, thus tending to urge the lever 24 to its upward position. When the bottle 12 is empty, the user removes the head 22 for placement on another bottle.

In practice, the bottle 12, valve 16 and syphon tube 18 are all formed from PET, both from a materials compatability standpoint and so that these parts can be easily recycled together. The bottle 12 is blow molded with biaxial orientation and the parts of the valve 16 are injection molded. The syphon flange 54 is attached to the housing 50 by ultrasonic welding. The valve housing 50 is then sealed to the inside of neck 14 of the bottle 12 by ultrasonic welding. During the ultrasonic welding, it is necessary to move the poppet 60 downward so that the valve 16 is in its open position, since the ultrasonic welding energy would otherwise permanently seal the valve 16 in its closed position. The base cup 20 is typically formed from polyethylene by injection molding. The base cup is easily separated from the bottle 12, valve 16 and syphon tube 18 at the time of recycling. The head 22 is injection molded from a polypropylene.

Figure 5A:
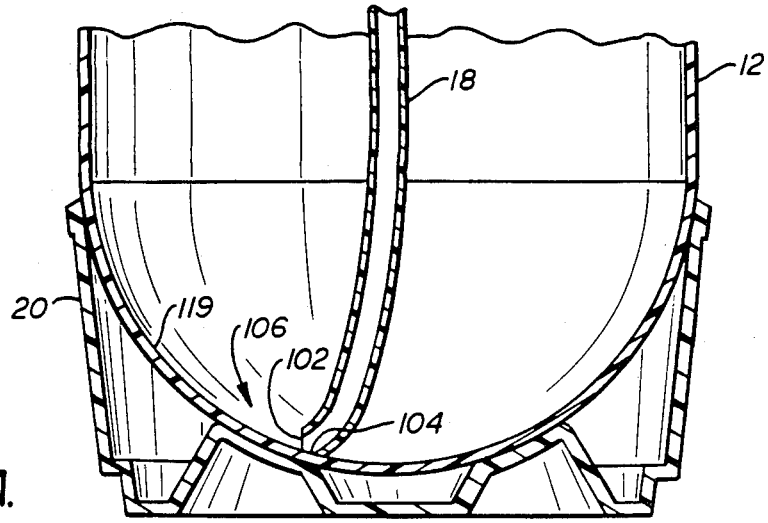
Figure 9:
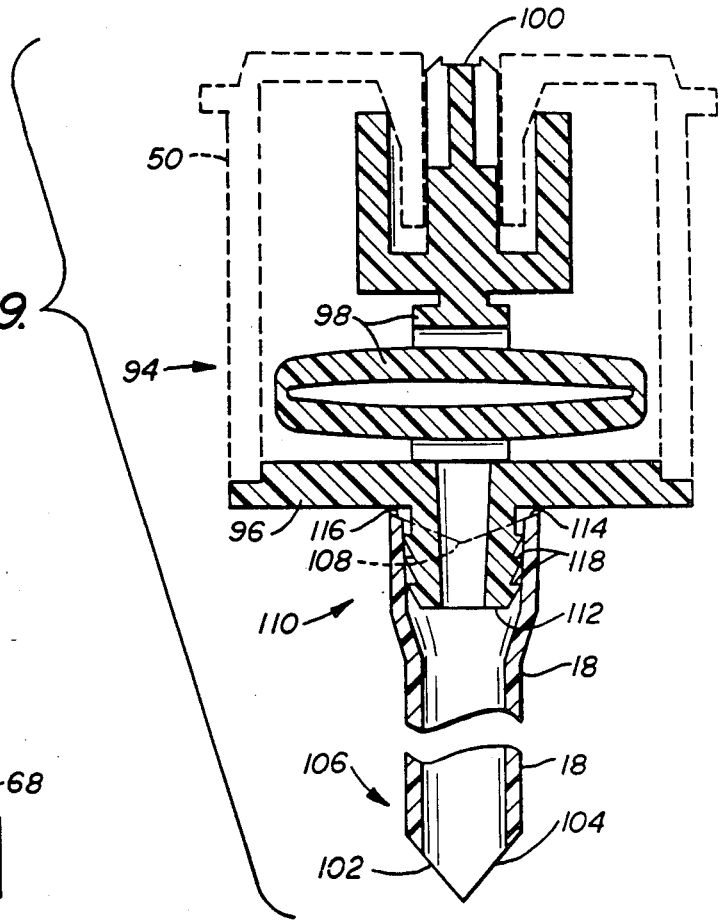
FIG. 9 is a cross section view of a portion of another syphon seltzer package in accordance with the invention.
Figure 7:
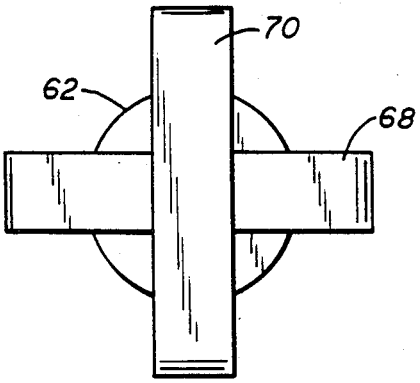
FIG. 7 is a bottom view of one part shown in the exploded side view of FIG. 4.
Figure 8:
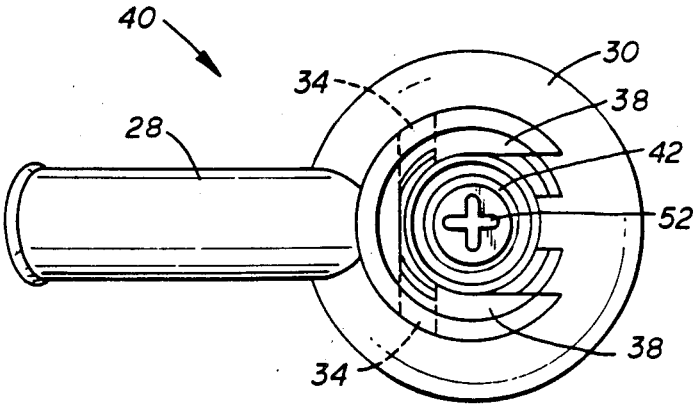
FIG. 8 is a top view of part of the syphon seltzer package shown in FIGS. 1, 5 and 6.

FIG. 9 shows another embodiment of a valve 94 in accordance with the invention. In the valve 94, the syphon flange 96 is integral with the spring 98 and the poppet 100. Other than a slight modification of the shape of the syphon flange 96 so that it and the spring 98 are joined together in the resulting integral structure, these parts and the remainder of a package incorporating the valve 94 has the same configuration as the FIGS. 1–8 embodiment. Also shown in FIG. 9 are the inclined edges 102 and 104 at end 106 of the syphon tube 18 and a groove 108 at end 110 of the syphon tube 18 which is complementary in shape with the edges 102 and 104. This configuration of the ends 106 and 110 of the syphon tube 18 means that the syphon tubes 18 can be cut from tube stock with no waste. When the syphon tube 18 is attached to fitting 112 on the syphon flange 96, tips 114 and 116 are splayed so that the groove 108 is above the ridges 118 on the fitting 112. The inclined edges 102 and 104 serve an important function, as shown in FIG. 5*a*. The system tube end 106 rests on the bottom 119 of the bottle 12. The pointed tip formed by the edges 102 and 104 means that the syphon tube 18 will not become blocked, regardless of the position of end 106 in the bottom 119. This position will change as the pressure inside bottle 12 is changed during filling and dispensing of the seltzer water 26 from the bottle 12. Such pressure changes result in changes of the length of the bottle 12.

Figure 10:
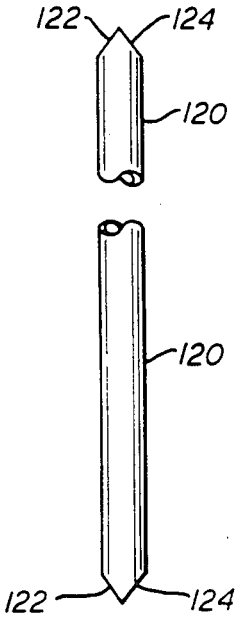
FIG. 10 is a side view of part of another embodiment of the invention.

FIG. 10 shows another form of a syphon tube 120 for use in the package of this invention. The syphon tube 120 has inclined edges 122 and 124 forming a pointed tip at both ends of the tube 120. The tube 120 is used in a syphon package otherwise as shown in FIGS. 1–8. The configurations of the syphon tubes 18 and 120 in FIGS. 9 and 10 add to the ease of automated assembly. The syphon tube 120 is symmetrical and does not need to be oriented by its ends.

FIGS. 11 and 12 show still another embodiment of a valve 130 in accordance with the invention. As in the valve 16 of the FIGS. 1–8 embodiment and the valve 94 of the FIG. 9 embodiment, the valve 130 has a generally cylindrical housing 132 and an integral spring 134 and poppet 136 combination. When the valve 130 is in its normally closed position as shown, cruciform cross section portion 138 of the poppet extends into centrally disposed opening 140 of the housing 132. Cup 142 surrounding the poppet 136 forms a PET to PET seal at 144 with flange 146 of the opening 140. This PET to PET seal 144 is formed by the combination of compression of the spring 134 and the pressure of the seltzer water in the bottle 12. The seal 144 is most effective at higher pressures, i.e. above about 40 p.s.i. to about 200 p.s.i. However, when the pressure inside the bottle 12 drops below about 40 p.s.i., the PET to PET seal 144 is sometimes ineffective, and leaks could occur through the valve 130 without another seal that is effective at lower pressures, i.e., between atmospheric pressure and about 50 p.s.i. Such a second seal 147 is formed between an elastomeric grommet 148 and the flange 146 of the housing 132. The elastomeric grommet 148 is located inside the cup 142, between the cup 142 and the poppet 136. The elastomeric grommet 148 has an upper ridge 150 engaging the flange 146 and a lower ridge 152 engaging bottom 154 of the cup 142. The grommet 148 is dimensioned so that it is compressed to form the seal 147 when the cup 142 engages the flange 146 to form the seal 144. In practice, the elastomeric grommet is formed, for example, from Santoprene synthetic rubber, obtainable from Monsanto Polymer Products, Akron, Ohio. With the seal 144 effective above 40 p.s.i. and the seal 147 effective below 50 p.s.i., the package is hermetically sealed under all pressure conditions when the valve 130 is closed. Even though the resilient seal 147 is formed in the valve 130, top 158 of the poppet 136 is precisely positioned when the valve 130 is closed because of the PET to PET seal 144. As a result, the poppet 136 is properly positioned with respect to an actuating rod of a dispensing head (not shown) in the same manner as shown in FIG. 5 for opening the valve 130 and for allowing it to close completely. Gap 160 is provided between the grommet 148 and the poppet 136 to allow pressure equalization along the grommet 148. If such a gap is not provided, pressure differences arising between the top and bottom of the grommet 148 while dispensing seltzer water from the bottle 12 may cause the grommet to move upward within the cup 142, sealing the valve 130 when it is desired to keep the valve open. Syphon tube flange 162 is precisely positioned to form the bottom of valve housing 132 by the interaction of upwardly extending wall 164 and groove 166 on the lower inside surface 168 of the housing 132. Rib 170 extends across inside surface 172 of the syphon tube flange 162 and provides support for the lower spring loop 134 on the syphon tube flange. The lower spring loop 134 just clears the inside of the upwardly extending wall 164. The valve housing 132 is fixed to the inside of the neck 14 of the bottle 12, preferably by an ultrasonic tack welding process, as described in the above-referenced copending Hagan application Ser. No. 893,041, filed Aug. 1, 1986. The valve housing 132 has a shallow groove 174 of about 0.0040 inch on its outside surface 176 around its bottom. This groove is provided so that stresses sufficient to damage the housing 132 will not be imparted by the neck 14 of the bottle 12 at the point of ring 178, where the neck 14 is less flexible than away from the ring 178. Syphon tube 180 has a straight cut top 182 and bottom 184. A conventional twist off aluminum closure cap 186 is attached to the neck of the bottle 12 for distribution and sale. The purchaser removes the cap 186 and replaces it with a dispensing head 22 (FIGS. 1, 2, 5, 6) for dispensing seltzer water from the bottle 12. Other than as shown and described, the construction and operation of the FIGS. 11 and 12 embodiment of the invention is the same as that of the FIGS. 1–8 embodiment.

It should now be readily apparent to those skilled in the art that a novel package, valve, integral poppet and spring structure and spring capable of achieving the stated objects of the invention has been provided. The novel spring and spring and poppet structure provides an improved, low cost valve capable of meeting the demands of a syphon seltzer water package. The valve and bottle may be formed from the same plastic material. In a preferred form of the package and valve, a combination of a first seal effective at higher pressures and a second seal effective at lower pressures insures that the package remains sealed under all pressure conditions encountered in use of the package.

It should further be apparent to those skilled in the art that various changes in form and details of the invention as shown and described may be made. It is intended that such changes be included within the spirit and scope of the claims appended hereto.

What is claimed is:

1. A package for dispensing a fluid in said package under gas pressure, which comprises a plastic container having a necked opneing with an inside surface and an outside surface, a dispensing head attached to the outside surface of said necked opening, and a normally closed valve mounted in the necked opening of said container and being free of attachment to the outside surface of said necked opening, said normally closed valve having a housing fixedly atached to the inside surface of the necked opening of said container, said housing having a supporting surface below the necked opening, an integral, one piece structure having a spring at a first end and a poppet at a second end, the spring end of said integral, one piece structure resting on said supporting surface, said spring comprising at least one loop formed from an upper arcuate portion and a lower arcuate portion each oriented along a first center line extending substantially normal to an axis running between the first and second ends of said integral, one piece structure, said housing having an orifice defining a valve seat at the necked opening of said container, the valve seat orifice being spaced from said supporting surface, said integral, one piece structure extending between said supporting surface and the valve seat orfice, said integral, one piece structure being dimensioned so that said spring is sufficiently compressed to bias the poppet end of said integral, one piece structure into sealing engagement with the valve seat orifice to form a first, relatively high pressure seal, means on said dispensing head to apply force in opposition to the biasing force from the spring to move the poppet end of said integral, one piece structure out of sealing engagement with the valve seat orifice to create a flow path for the fluid in the package through the valve housing, the valve seat orifice and the necked opening of said container, and means at the poppet end of said integral, one piece structure for forming a second, relatively low pressure seal with the valve seat orifice.

2. The package for dispensing a fluid of claim 1 in which said integral, one piece structure is formed from plastic.

3. The package for dispensing a fluid of claim 1 in which said force applying means comprises a manually engageable actuating lever pivotally attached to said dispensing head by means of opposing projections extending from the actuating lever, said actuating lever having an upper surface configured to form part of a top of said dispensing head, said actuating lever having a curved, finger engageable portion extending laterally from the dispensing head top portion of the upper surface, an actuating rod movably mounted inside said dispensing head and positioned to be engaged by said actuating lever when, said actuating lever is pivoted downward, said dispensing head having a groove extending downward from the top of said dispensing head, the groove being positioned so that the finger engageable portion of said actuating lever will move downward in the groove when said actuating lever is pivoted downward.

4. The package for dispensing a fluid of claim 1 additionally comprising a syphon tube extending downward proximate to a bottom of said container, said syphon tube having a flanged upper end, said flanged upper end being attached to said valve housing to form the supporting surface.

5. The package for dispensing a fluid of claim 4 in which said flanged upper end has a plurality of upwardly extending registration pins configured and positioned to aid registration of said flanged upper end during assembly of said flanged upper end and said valve housing.

6. The package for dispensing a fluid of claim 1 in which the poppet end of said integral structure is configured for sealing engagement with the valve seat orifice to form the first, relatively high pressure seal by having a cup shaped member with an upwardly extending wall surrounding said poppet, said valve seat orifice having a downwardly extending flange and said cup shaped member having its upwardly extending wall engaging the downwardly extending flange.

7. The package for dispensing a fluid of claim 6 in which said means for forming a second, relatively low pressure seal comprises a resilient grommet surrounding said poppet between said poppet and said cup shaped member, said resilient grommet engaging the downwardly extending flange to form a second seal when said valve is closed.

8. The package for dispensing a fluid of claim 1 in which the spring end of said integral, one piece structure includes at least a second loop formed from an upper arcuate portion and a lower arcuate portion each oriented along a second center line extending substantially normal to the axis running between the first and second ends of said integral, one piece structure, the second center line being oriented at an angle relative to the first center line.

9. The package for dispensing a fluid of claim 8 in which the second center line is at a substantially right angle to the first center line.

10. The package for dispensing a fluid of claim 9 additionally comprising a third loop formed from an upper arcuate portion and a lower arcuate portion each oriented along a third center line extending substantially normal to the axis running between the first and second ends of said integral, one piece structure, the third center line being oriented substantially parallel to the first center line.

11. A package for dispensing a fluid in said package under gas pressure, which comprises a plastic container having a necked opening with an inside surface and an outside surface, a dispensing head attached to the necked opening, and a normally closed valve mounted in the necked opening of said container and being free of attachment to the outside surface of said necked opening, said normally closed valve having a housing fixedly attached to the inside surface of the necked opening of said container, said housing having a supporting surface below the necked opening, an integral, one piece structure having a spring at a first end and a poppet at a second end, the spring end of said integral, one piece structure resting on said supporting surface, said housing having an orifice defining a valve seat at the necked opening of said container, the valve seat orifice being spaced from said supporting surface, said integral, one piece structure extending between said supporting surface and the valve seat orifice, the poppet end of said integral, one piece structure being configured for sealing engagement with the valve seat orifice by having a cup shaped member surrounding said poppet, said valve seat orifice having a downwardly extending flange and said cup shaped member engaging the downwardly extending flange to form a first, relatively high pressure seal, a resilient grommet surrounding said poppet between said poppet and said cup shaped member, said resilient grommet engaging the downwardly extending flange to form a second, relatively low pressure seal when said valve is closed, said integral, one piece structure being dimensioned so that said spring is sufficiently compressed to bias the poppet end of said integral, one piece structure into sealing engagement with the valve seat orifice, and means on said dispensing head to apply force in opposition to the biasing force from the spring to move the poppet end of said integral structure and said rsilient grommet out of sealing engagement with the flange of the valve seat orifice to create a flow path for the fluid in the package through the valve housing, the valve seat orifice and the necked opening of said container.

12. The package for dispensing a fluid of claim 11 in which said integral, one piece structure is formed from plastic.

13. The package for dispensing a fluid of claim 12 in which said resilient grommet is configured to provide a gap extending from the top to the bottom of said resilient grommet between said cup shaped member and said poppet.

14. The package for dispensing a fluid of claim 12 in which the necked opening of said plastic container has a ring shaped portion of increased thickness on an outer surface of the necked opening, said housing fits into the necked opening in an inteference fit above the ring shaped portion of increased thickness and an outer surface of said housing has a groove at the ring shaped portion of increased thickness of the necked opening of said container.

15. A sealed package for shipping and storing a fluid under pressure, which comprises a plastic container having a necked opening with an inside surface and an outside surface, a normally closed valve mounted in the necked opening of said container, said normally closed valve having a housing fixedly attached to the inside surface of the necked opening of said container and being free of attachment to the outside surface of said necked opening, said housing having a supporting surface below the necked opening, an integral, one piece structure having a spring at a first end and a poppet at a second end, the spring end of said integral, one piece structure resting on said supporting surface, said spring comprising at least one loop formed from an upper arcuate portion and a lower arcuate portion each oriented along a first center line extending substantially normal to an axis running between the first and second ends of said integral structure, said housing having an orifice defining a valve seat at the necked opening of said container, the valve seat orifice being spaced from said supporting surface, said integral, one piece structure extending between said supporting surface and the valve seat orifice, said integral, one piece structure being dimensioned so that said spring is sufficiently compressed to bias the poppet end of said integral, one piece structure into sealing engagement with the valve seat orifice to form a first relatively high pressure seal, and means on said poppet for forming a second relatively low pressure seal with said valve seat orifice, integrally formed threads on the outside surface of said necked opening, and a removable closure cap having mating threads engaging the integrally formed threads on the outside surface of said necked opening.

16. The package for shipping and storing a fluid of claim 15 in which said integral, one piece structure is formed from plastic.

17. The package for dispensing a fluid of claim 15 in which the poppet end of said integral, one piece structure is configured for sealing engagement with the valve seat orifice by engaging said housing around said valve seat orifice which forms said first, relatively high pressure seal.

18. The package for dispensing a fluid of claim 17 wherein said second sealing means comprises a resilient member configured and positioned to extend between the poppet end and said housing around said valve seat orifice to form said second, relatively low pressure seal when said valve is closed.

19. The package for dispensing a fluid of claim 15 in which the spring end of said integral, one piece structure includes at least a second loop formed from an upper arcuate portion and a lower arcuate portion each oriented along a second center line extending substantially normal to the axis running between the first and second ends of said integral, one piece structure, the second center line being oriented at an angle relative to the first center line.

20. The package for dispensing a fluid of claim 19 in which the second center line is at a substantially right angle to the first center line.

21. The package for dispensing a fluid of claim 20 additionally comprising a third loop formed from an upper arcuate portion and a lower arcuate portion each oriented along a third center line extending substantially normal to the axis running between the first and second ends of said integral, one piece structure, the third center line being oriented substantially parallel to the first center line.

22. A sealed package for shipping and storing a fluid under pressure, which comprises a plastic container having a necked opening with an inside surface and an outside surface, a normally closed valve mounted in the necked opening of said container, said normally closed valve having a housing fixedly attached to the inside surface of the necked opening of said container, said housing having a supporting surface below the necked opening, an integral, one piece structure having a spring at a first end and a poppet at a second end, the spring end of said integral, one piece structure resting on said supporting surface, said housing having an orifice defining a valve seat at the necked opening of said container, the valve seat orifice being spaced from said supporting surface, said integral, one piece structure extending between said supporting surface and the valve seat orifice, the poppet end of said integral, one piece structure being configured for sealing engagement with the valve seat orifice by engaging said housing around said valve seat orifice to form a first, relatively high pressure seal, a resilient member configured and positioned to extend between the poppet end and said housing around said valve seat orifice to form a second, relatively low pressure seal when said valve is closed, said integral, one piece structure being dimensioned so that said spring is sufficiently compressed to bias the poppet end of said integral, one piece structure into sealing engagement with the valve seat orifice, integrally formed threads on the outside surface of said necked opening, and a removable closure cap having mating threads engaging the integrally formed threads on the outside surface of said necked opening.

23. The package for shipping and storing a fluid of claim 22 in which said integral, one piece structure is formed from plastic.

24. The package for shipping and storing a fluid of claim 23 in which the necked opening has a ring shaped portion of increased thickness on the outside surface of said necked opening, said housing fits into the necked opening in an inteference fit above the ring shaped portion of increased thickness and an outer surface of said housing has a groove at the ring shaped portion of increased thickness of said necked opening.

* * * * *